US007458484B2

(12) United States Patent
Stevens

(10) Patent No.: US 7,458,484 B2
(45) Date of Patent: Dec. 2, 2008

(54) DEVICE FOR EJECTING BLISTER TABLETS

(75) Inventor: Gerard Stevens, Huntleys Point (AU)

(73) Assignee: Manrex Pty. Ltd., Mortlake, NSW (AU)

( * ) Notice: Subject to any disclaimer, the term of this patent is extended or adjusted under 35 U.S.C. 154(b) by 179 days.

(21) Appl. No.: 10/526,141

(22) PCT Filed: Aug. 19, 2003

(86) PCT No.: PCT/SU03/01047

§ 371 (c)(1),
(2), (4) Date: Feb. 28, 2005

(87) PCT Pub. No.: WO2004/020290

PCT Pub. Date: Mar. 11, 2004

(65) Prior Publication Data

US 2006/0060597 A1 Mar. 23, 2006

(30) Foreign Application Priority Data

Aug. 28, 2002 (AU) ..... 2002951072

(51) Int. Cl.
*G07F 11/72* (2006.01)

(52) U.S. Cl. ..... 221/30; 221/31; 221/87; 221/88

(58) Field of Classification Search ..... 221/25, 221/26, 27, 28, 30, 31, 87, 89, 69
See application file for complete search history.

(56) References Cited

U.S. PATENT DOCUMENTS 4,802,493 A * 2/1989 Maganias ..... 600/556
5,009,561 A * 4/1991 Lombardino et al. ..... 221/25
5,931,794 A * 8/1999 Pitesky ..... 600/556
6,660,018 B2 * 12/2003 Lum et al. ..... 606/181

* cited by examiner

*Primary Examiner*—Gene O. Crawford
*Assistant Examiner*—Timothy Waggoner
(74) *Attorney, Agent, or Firm*—Smith-Hill and Bedell

(57) ABSTRACT

A device for dislodging tablets from the interior of a blister comprises a cup having a circular side wall which can be comfortably gripped in the hand. The interior of the cup is provided with a central upward projection which extends above the cup side wall and has its free end shaped to rupture easily a foil backing to the blister so that the tablets can be dislodged from the blister by twisting the cup and fall into the cup from which they are readily recovered.

10 Claims, 2 Drawing Sheets

DEVICE FOR EJECTING BLISTER TABLETS

This is a national stage application filed under 35 USC 371 based on International Application No. PCT/AU2003/001047 filed Aug. 19, 2003, and claims priority under 35 USC 119 of Australian Patent Application No. 2002951072 filed Aug. 28, 2002.

FIELD OF THE INVENTION

THIS INVENTION relates to a device for removing tablets from a blister of a blister sheet by way of its foil backing which seals the tablets into the blister.

State of the Art

The conventional way of removing tablets from a blister is by depressing the convex face of the blister so that the tablets are forced by finger pressure through the foil backing sheet behind it. Unfortunately the finger pressure which must be exerted on the face of the blister to eject the tablets it contains, may sometimes be excessive for an elderly and possibly frail patient to apply.

Object of the Invention

An object of this invention is to provide a device which avoids a patient having to use finger pressure to eject tablets from a blister.

The Invention

In accordance with the present invention a device for ejecting tablets from a blister of a blister sheet through a foil backing sheet, comprises a cup having a rim which can be placed against the underside of the backing sheet around the position of the blister, and a projection for rupturing the foil and extending upwardly above the rim of the cup in the vicinity of its central portion, the projection being used to strip the foil of the backing sheet away from the underside of the blister so that the tablets fall through the ruptured foil into the cavity of the cup from which they can be retrieved by the patient.

Preferred Features of the Invention

Preferably the projection is constructed as a blade which can be turned by twisting the cup once the blade has perforated the foil. The turning action strips away the foil from the sides of the blister to leave a large opening through which all the tablets can drop into the cup.

To facilitate the perforation of the foil, the end of the blade is conveniently serrated. The shape and arrangement of the serrations may be varied to accommodate a wide variety of blister sizes and shapes.

Introduction to the Drawing

The invention will now be described in more detail, by way of examples, with reference to the accompanying drawing, in which;

IN THE DRAWINGS

DESCRIPTION OF FIRST EMBODIMENT

Figure 1:
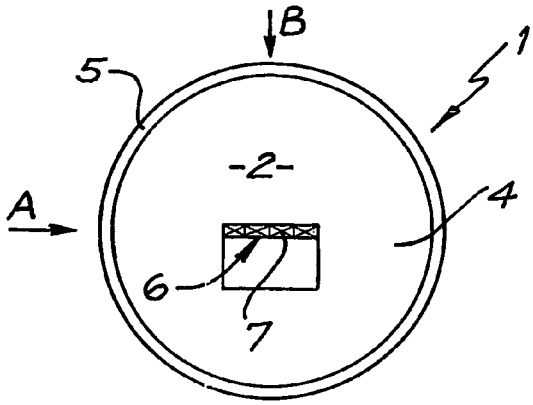
FIG. 1 is a plan view of a device for ejecting tablets from a blister of a blister sheet.
Figure 2:
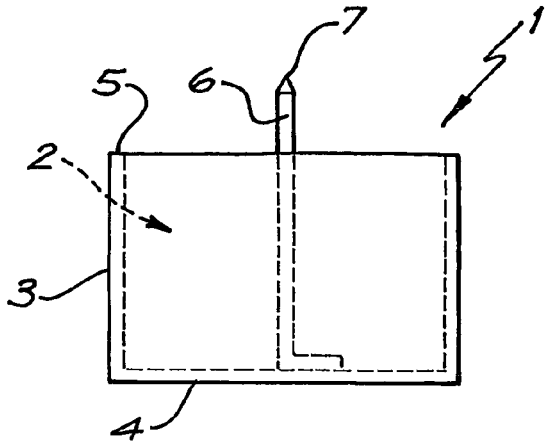
FIGS. 2 and 3 are respectively side views of the device as viewed in the directions of the arrows A and B, respectively, in FIG. 1.

FIGS. 1 and 2 show a device 1 comprising a circular cup 2 made from plastics material and about five centimeters in diameter. The cup 2 has a cylindrical side-wall 3 and a circular base 4. The side wall is about three centimeters high and terminates in a circular rim 5. It will be appreciated that the cup 2 may be oblong instead of circular, to facilitate a manual grip on it by the fingers and hand of the user and to make twisting of it a little easier. been explained with reference to FIG. 4. The body of the stalk 24 is of conical shape and tapers upwardly from an annular portion 27 which is formed around the marginal edge-portion of its upper surface with a moat 28 of U-shaped cross-section and which encircles the root of the stalk 24. The peripheral edge of the annular portion 27 fits snugly against the interior wall of the cup 21. A threaded stub shaft 29 projects downwardly from the underside of the annular portion 27 and is screwed into the central threaded opening 22 of the cup 21.

Operation of a Second Embodiment

When the device is in use, the foil backing strip of a blister cavity is perforated by the chevron of the blade which strips away the remainder of the foil sealing the underside of the blister as a result of the manual rotation of the cup. This allows the tablets in the cavity of the blister to drop into the moat 28 of the cup. As the interior of the cup is devoid of sharp corners it can easily be kept clean.

Description of Third Embodiment

Figure 6:
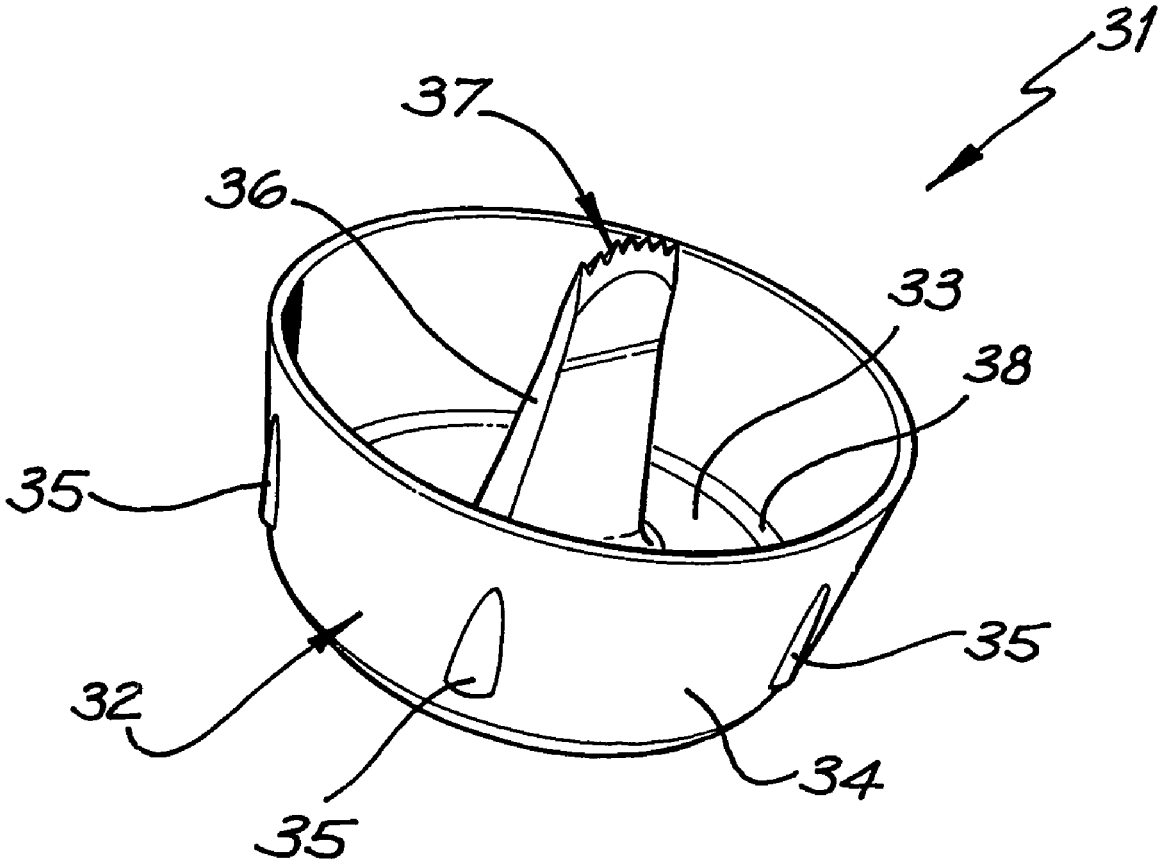
FIG. 6 is a third embodiment of the device shown in perspective view.

In a third embodiment of the invention shown in FIG. 6 a device 31 is formed as a unitary plastics moulding in the shape of a cup 32 having a circular flat base 33 of 5½ centimeters diameter. The under edge of the base curves upwardly to provide an upwardly divergent annular side wall 34 to the cup. The wall has a height of about 2⅜ centimeters. Ribs 35 are spaced from one another around the outside of the side wall 34 to facilitate a grip by the hand of the user.

The interior of the cup provides a well 2½ centimeters deep and a round opening of 5½ centimeters diameter.

Centred in the well is an upwardly tapering projection 36 shaped as a blade of rectangular cross-section which projects about 1 centimeter above the cup side wall. The top 37 of the blade is about 14×1 millimeters in cross-section and it has a serrated gently-convex end for assisting its insertion through a foil backing of a blister cavity. All of the inside corner surfaces 38 of the well are rounded and the cup can be easily cleaned in consequence.

Figure 3:
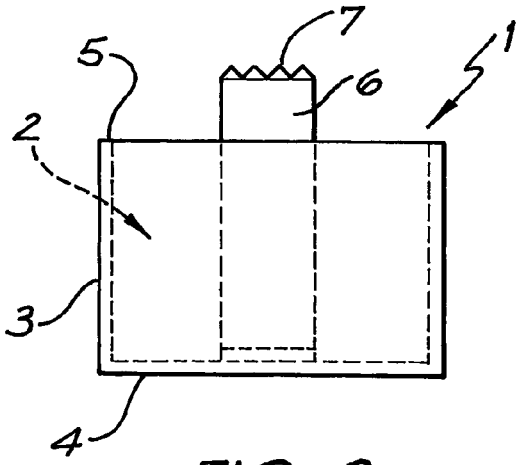

As shown in FIGS. 2 and 3, an L-shaped rigid member 12 provides with its longer limb 13 a projection 6 shaped as a blade. The member 12 is attached to the base 4 of the cup by its shorter limb 14. The projection 6 extends upwardly through its central portion for about four-and-a-half centimeters. The upper part of the projection therefore extends about one-and-a-half centimeters above the rim 5 of the cup. This of course may be varied to suit various shapes and depths of blisters. The upper end of the projection is serrated at 7 to provide a line of saw-teeth.

Figure 4:
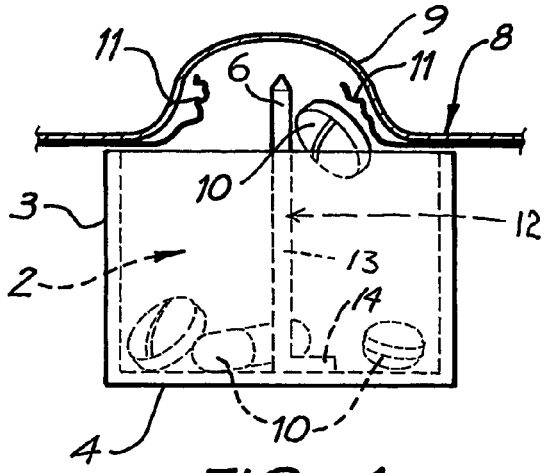
FIG. 4 shows the device in use to dislodge tablets from a blister.

FIG. 4 shows a blister sheet 8 having a blister 9 from which tablets 10 are to be dislodged by the use of the device 1. The opening of the blister 9 is normally sealed by a foil backing sheet 11 which is easily ruptured by the serrated end 7 and which seals the tablets 9 in the cavity of the blister.

Operation of First Embodiment

To eject the tablets 10 from the blister 9 the cup 2 is raised beneath the underside of the foil backing sheet 11 so that the saw-toothed end 7 of the blade 6 ruptures the sheet 11 and enters the cavity of the blister. Simultaneously the circular rim 5 of the cup is pressed against the underside of the sheet 11 around the marginal under edge of the blister to prevent unwanted escape of the tablets from the cup 2. The cup 2 is then rotated so that the blade 6 inside the blister cavity strips away the foil 11 from the edge of the blister and dislodges the tablets 10 from the blister cavity so that they all fall through the ruptured foil 11 into the cup 2. They can then be retrieved from the cavity of the cup by the patient.

Extraction of the tablets 10 from the cavity of the blister 9 thus takes place easily without risk of any of the tablets being lost or trapped in the blister.

Description of Second Embodiment

Figure 5:
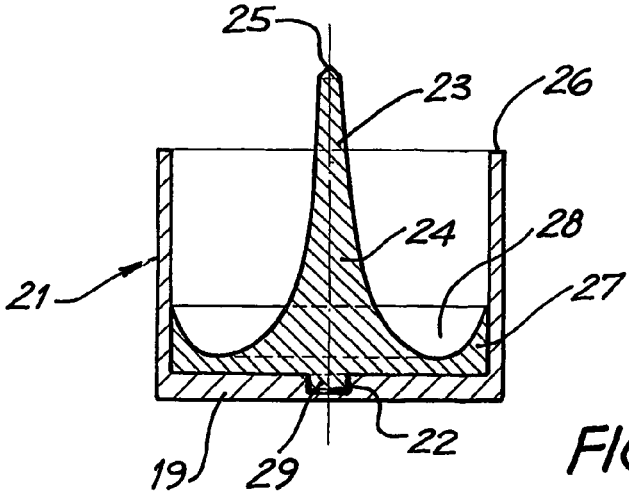
FIG. 5 shows in vertical section an alternative shape of device.

FIG. 5 shows a device made in two parts which are screwed together and which enable cleaning of the device to be carried out easily. The device comprises a polished metal cup 21 having a central threaded opening 22 in its base 19. A projection 23 for removing tablets from a blister is also made of polished metal and has a tapering central stalk 24 terminating at its upper end in a chevron-shaped blade 25 located above the rim 26 of the cup 21 and for rupturing a foil backing sheet of a sealed blister.

The invention claimed is:

1. A device for ejecting tablets from a blister of a blister sheet through a foil backing sheet, comprising a cup having a base and a side wall defining a cavity, the side wall having a rim which can be placed against the underside of the backing sheet around the position of the blister, and a projection for rupturing the foil and extending upwardly from a central region of the base and extending above the rim of the cup, whereby the cavity forms a moat that surrounds the projection, the projection being used to strip the foil of the backing sheet from the underside of the blister so that the tablets fall through the ruptured foil into the moat from which they can be retrieved by the patient, and in which the corner regions in the interior of the cup are rounded to facilitate its cleaning.

2. A device for ejecting tablets from a blister of a blister sheet through a foil backing sheet, comprising a cup having a base and a side wall defining a cavity, the side wall having a rim which can be placed against the underside of the backing sheet around the position of the blister, and a projection for rupturing the foil and extending upwardly from a central region of the base and extending above the rim of the cup, whereby the cavity forms a moat that surrounds the projection, the projection being used to strip the foil of the backing sheet from the underside of the blister so that the tablets fall through the ruptured foil into the moat from which they can be retrieved by the patient, and in which the cup is of circular cross-section and the projection is of rectangular cross-section.

3. A device as set forth in claim 2, in which the projection is constructed as an upwardly directed blade.

4. A device as set forth in claim 2, in which the upper end of the blade is serrated to assist rupturing of the foil.

5. A device as set forth in claim 2, in which the projection tapers progressively in cross-section towards its free end.

6. A device as set forth in claim 2, in which the upper end of the projection is convex.

7. A device as set forth in claim 2, wherein the projection extends about one centimeter above the rim of the cup.

8. A device as set forth in claim 2, wherein the projection is a blade having an upper end that extends substantially along a diameter of the cup and includes teeth spaced apart along said diameter to assist rupturing of the foil.

9. A device as set forth in claim 1, in which the side wall of the cup is gently upwardly divergent.

10. A device as set forth in claim 1, in which the mouth of the cup is between five and six centimeters in diameter, the height of the cup wall interior is about 2.75 centimeters, and the projection extends about one centimeter above the side wall of the cup.

* * * * *